US008631593B1

(12) United States Patent
Ferris

(10) Patent No.: US 8,631,593 B1
(45) Date of Patent: Jan. 21, 2014

(54) SNOW REMOVAL DEVICE

(76) Inventor: Lynn A. Ferris, Buchanan, MI (US)

( * ) Notice: Subject to any disclaimer, the term of this patent is extended or adjusted under 35 U.S.C. 154(b) by 108 days.

(21) Appl. No.: 13/464,901

(22) Filed: May 4, 2012

(51) Int. Cl.
*E01H 5/06* (2006.01)
*E01H 5/02* (2006.01)

(52) U.S. Cl.
USPC ..... 37/270; 37/278

(58) Field of Classification Search
USPC ..... 37/270, 272, 278, 285, 264, 265, 283, 37/284; 294/54.5, 57
See application file for complete search history.

(56) References Cited

U.S. PATENT DOCUMENTS

| | | | | | |
|---|---|---|---|---|---|
| 157,078 | A | * | 11/1874 | Parker et al. | 37/274 |
| 745,608 | A | * | 12/1903 | Heermans | 37/277 |
| 801,090 | A | * | 10/1905 | Kenney | 37/277 |
| 845,549 | A | | 2/1907 | Henry | |
| 1,101,149 | A | * | 6/1914 | Schoener | 172/381 |
| 1,276,672 | A | * | 8/1918 | Mason, Jr. | 37/273 |
| 1,561,651 | A | * | 11/1925 | Lavell | 37/277 |
| 1,779,090 | A | * | 10/1930 | Fick | 37/278 |
| 2,460,560 | A | | 2/1949 | Williams | |
| 2,734,291 | A | * | 2/1956 | Lasker | 294/54.5 |
| 2,773,318 | A | | 12/1956 | Hemsath at el. | |
| 2,895,237 | A | | 7/1959 | Abrahams | |
| 2,933,836 | A | * | 4/1960 | McKinley | 37/265 |
| 3,260,002 | A | * | 7/1966 | Bresch | 37/278 |
| D310,225 | S | * | 8/1990 | Eberle | D15/11 |
| 5,271,169 | A | * | 12/1993 | Konsztowicz | 37/271 |
| D390,575 | S | * | 2/1998 | LeBlanc | D15/11 |
| D407,723 | S | | 4/1999 | Weisman et al. | |
| 5,906,060 | A | | 5/1999 | Tonry | |
| 7,810,259 | B1 | * | 10/2010 | Goldman | 37/285 |
| D656,162 | S | * | 3/2012 | Wiik | D15/11 |
| 2009/0013564 | A1 | | 1/2009 | Mallaridas | |
| 2012/0047777 | A1 | * | 3/2012 | Andreas | 37/270 |

* cited by examiner

*Primary Examiner* — Thomas B Will
*Assistant Examiner* — Joan D Misa

(57) ABSTRACT

A manually driven, skid mounted removal device for clearing accumulated snow has a structural member with a generally "U" shaped handle. A handle first end is located on a first anterior vertical support middle. A handle second end is located on a second anterior vertical support middle. The handle is located at an angle between 0 and 90 degrees with respect to a ground surface. The device has a generally wedge shaped blade located on a top of the structural member.

2 Claims, 4 Drawing Sheets

SNOW REMOVAL DEVICE

BACKGROUND OF THE INVENTION

Various forms of shovels have been used since Neolithic times as a primary means for excavation. It is very likely that shovels were adapted early on to remove snow out of traffic areas in and around human settlements. Typically snow shovels use a wide blade to either remove the snow or push it out of the way. Snowplows attached to a vehicle, appearing as early as 1920 were found to provide a much more efficient means of snow removal in comparison to a simple snow shovel. Snow blowers which were in use by the railroads in the late 1870s have had versions find their way to many households—especially in colder climates. The present invention features a manually driven, skid mounted removal device for clearing accumulated snow.

SUMMARY

In some embodiments, the device comprises a structural member with a generally "U" shaped handle. In some embodiments, a handle first end is located on a first anterior vertical support middle. In some embodiments, a handle second end is located on a second anterior vertical support middle. In some embodiments, the handle is located at an angle between 0 and 90 degrees with respect to a ground surface. In some embodiments, the device comprises a generally wedge shaped blade located on a top of the structural member.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

DESCRIPTION OF PREFERRED EMBODIMENTS

Following is a list of elements corresponding to a particular element referred to herein:

| | |
|---|---|
| 100 | Snow removal device |
| 200 | Structural member |
| 210 | First anterior vertical support |
| 212 | First anterior vertical support first end |
| 214 | First anterior vertical support middle |
| 220 | Second anterior vertical support |
| 222 | Second anterior vertical support first end |
| 224 | Second anterior vertical support middle |
| 230 | First posterior vertical support |
| 232 | First posterior vertical support first end; |
| 234 | First posterior vertical support middle |
| 240 | Second posterior vertical support |
| 242 | Second posterior vertical support first end; |

-continued

| | |
|---|---|
| 244 | Second posterior vertical support middle |
| 250 | Anterior horizontal support |
| 252 | Anterior horizontal support first end |
| 254 | Anterior horizontal support second end |
| 260 | Posterior horizontal support |
| 262 | Posterior horizontal support first end |
| 264 | Posterior horizontal support second end |
| 270 | First runner |
| 272 | First runner first end |
| 274 | First runner middle |
| 276 | First runner second end |
| 280 | Second runner |
| 282 | Second runner first end |
| 284 | Second runner middle |
| 286 | Second runner second end |
| 290 | Handle |
| 292 | Handle first end |
| 294 | Handle second end |
| 300 | Blade |
| 310 | Blade first side |
| 312 | Blade first side lower edge |
| 314 | Blade first side upper edge |
| 316 | Blade first side rear edge |
| 318 | Blade first side first end |
| 320 | Blade second side |
| 322 | Blade second side lower edge |
| 324 | Blade second side upper edge |
| 326 | Blade second side rear edge |
| 328 | Blade second side first end |
| 330 | Plane A, |
| 510 | First side rear section, |
| 520 | Second side rear section, |
| 550 | Plane B, |
| 560 | Plane C |

Figure 1:
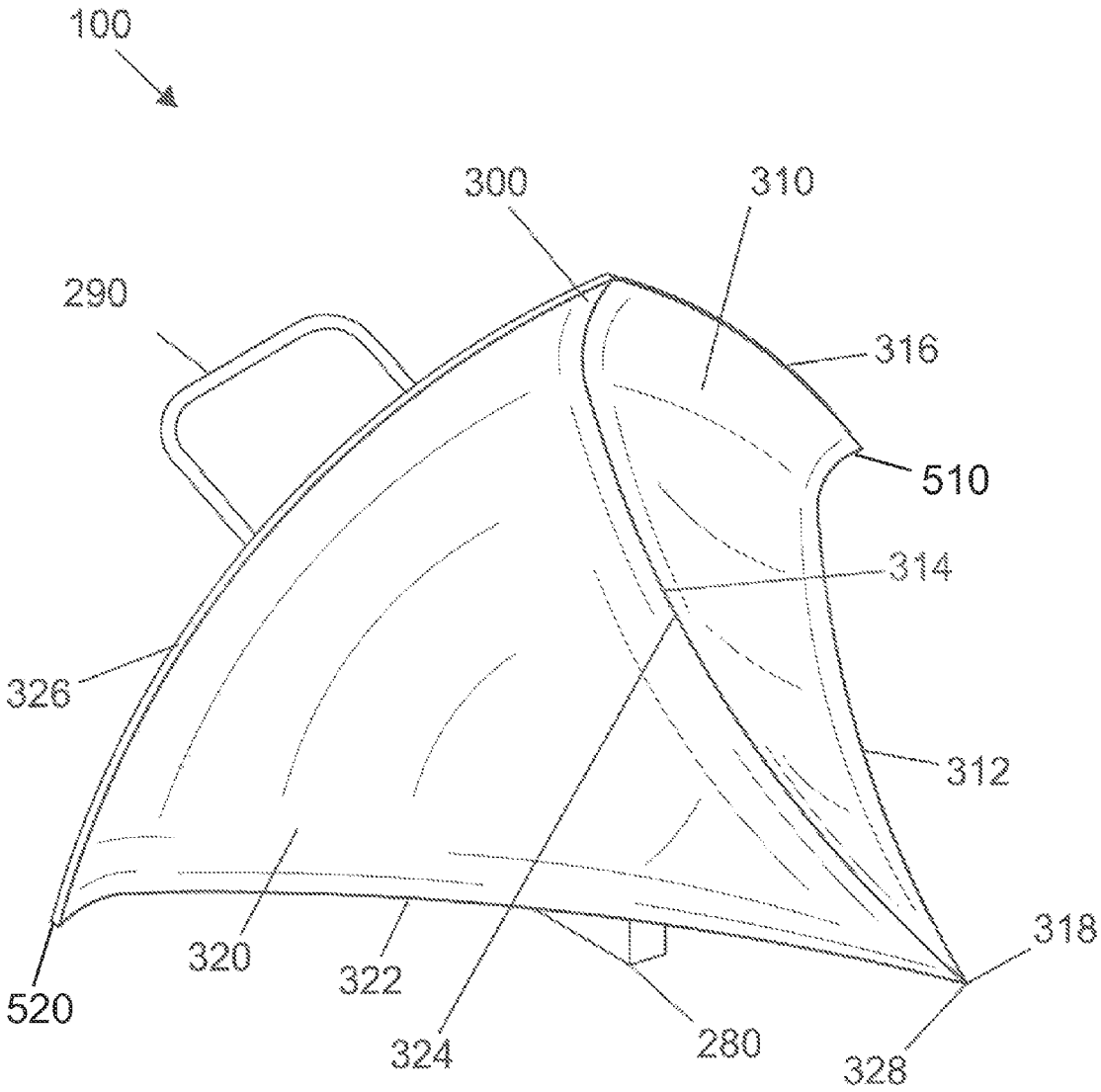
FIG. 1 is a perspective view of the present invention.
Figure 2:
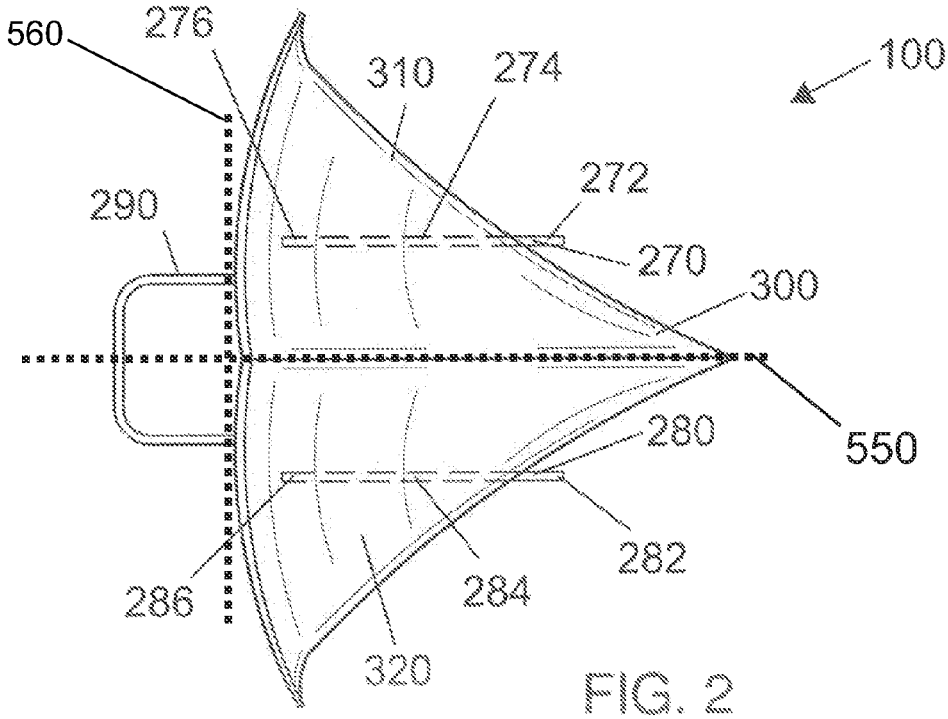
FIG. 2 is a top view of the present invention.
Figure 3:
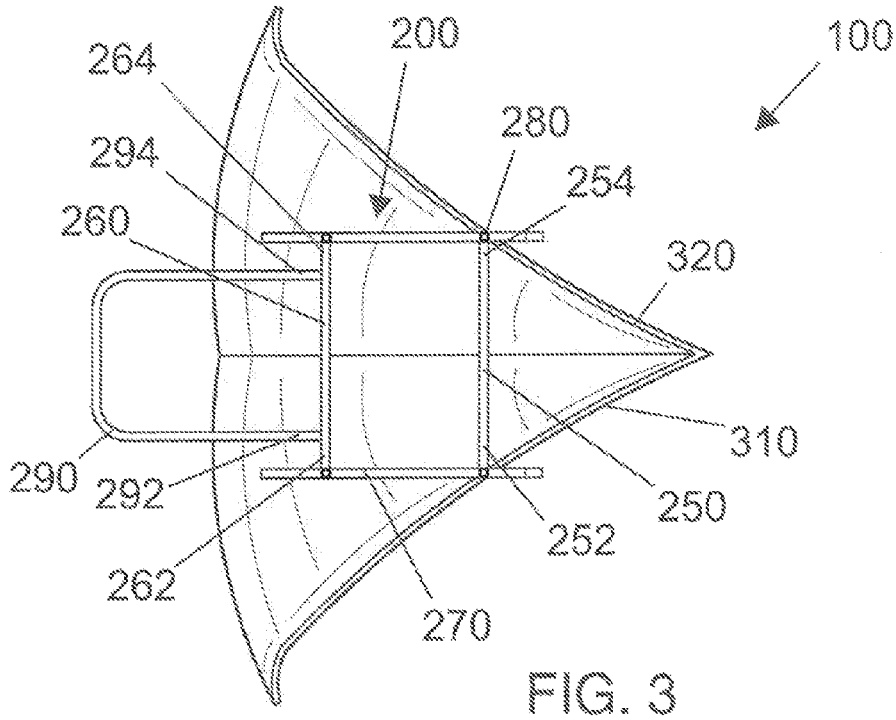
FIG. 3 is a bottom view of the present invention.
Figure 4:
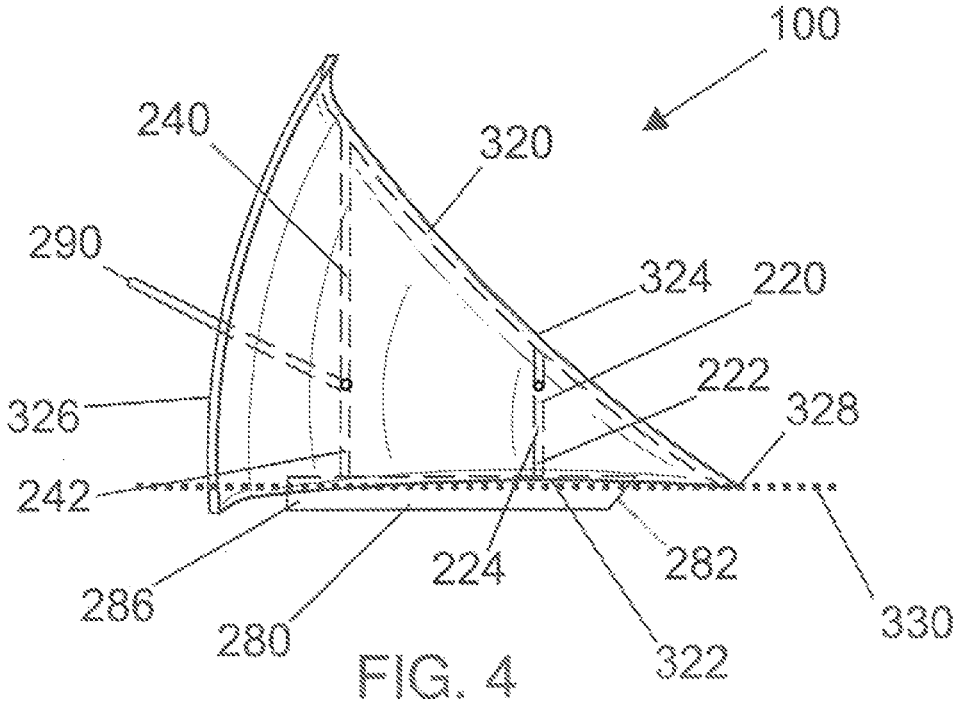
FIG. 4 is a second side view of the present invention.
Figure 5:
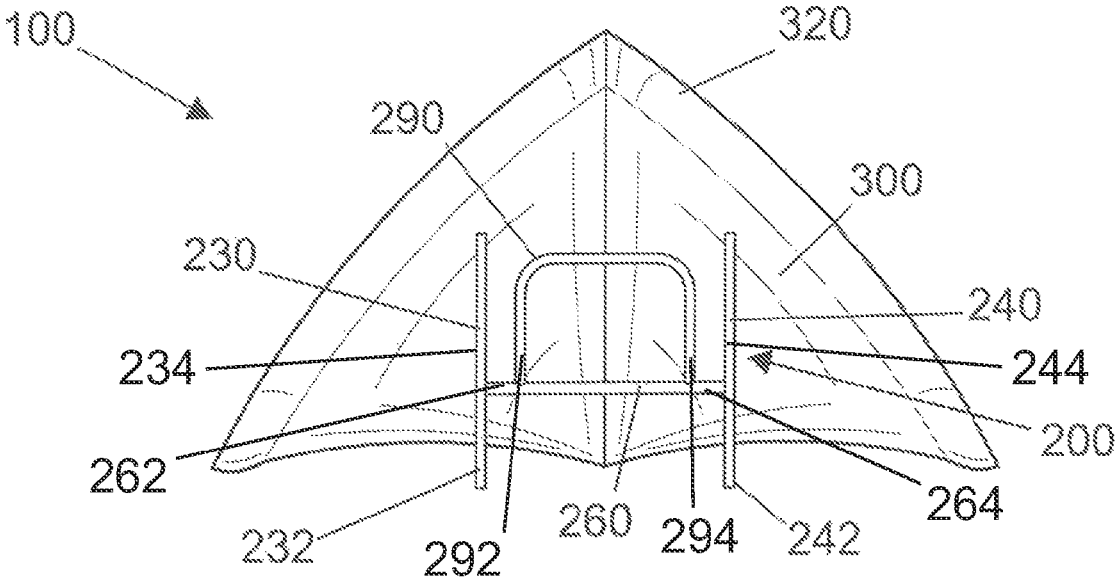
FIG. 5 is a rear view of the present invention.
Figure 6:
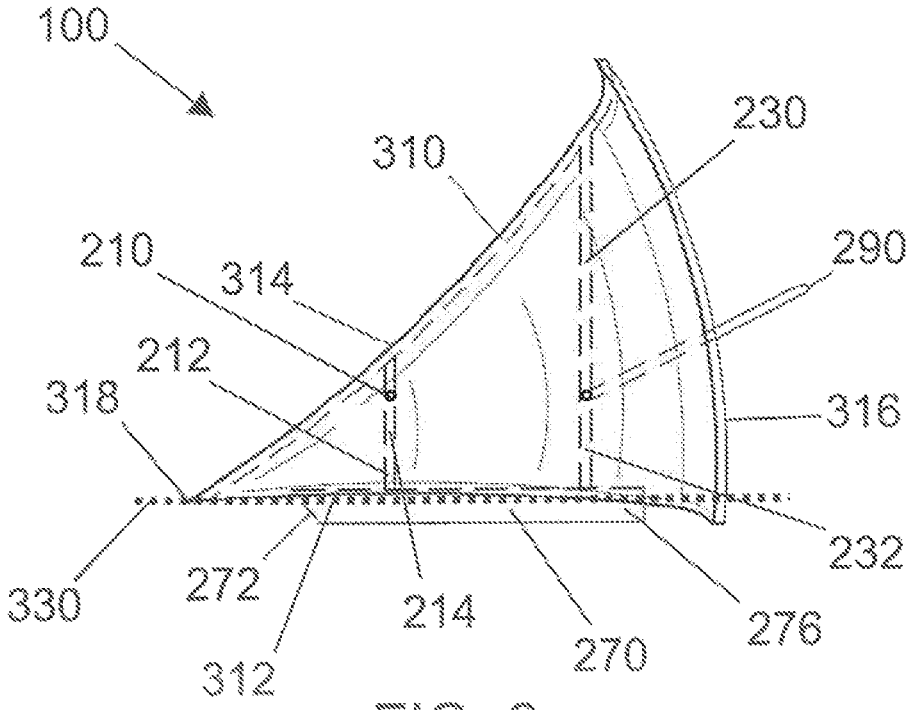
FIG. 6 is a first side view of the present invention.

Referring now to FIG. 1-6, the present invention features a manually driven, skid mounted snow removal device (100) for clearing accumulated snow. In some embodiments, the device (100) comprises a structural member (200) having a first anterior vertical support (210), a second anterior vertical support (220), a first posterior vertical support (230), a second posterior vertical support (240), an anterior horizontal support (250), a posterior horizontal support (260), a first runner (270), a second runner (280), and a generally "U" shaped handle (290).

In some embodiments, the first anterior vertical support first end (212) is vertically located on and perpendicular to the first runner (270) between a first runner first end (272) and a first-runner middle (274). In some embodiments, the second anterior vertical support first end (222) is vertically located on and perpendicular to the second runner (280) between a second runner first end (282) and a second runner middle (284).

In some embodiments, the first posterior vertical support first end (232) is vertically located on and perpendicular to the first runner (270) close to a first runner second end (276). In some embodiments, the second posterior vertical support first end (242) is vertically located on and perpendicular to the second runner (280) close to a second runner second end (286).

In some embodiments, the anterior horizontal support first end (252) is horizontally located on and perpendicular to a first anterior vertical support middle (214). In some embodiments, the anterior horizontal support second end (254) is horizontally located on and perpendicular to a second anterior vertical support middle (224).

In some embodiments, the posterior horizontal support first end (262) is horizontally located on and perpendicular to a first posterior vertical support middle (234). In some embodiments, the posterior horizontal support second end (264) is horizontally located on and perpendicular to a second posterior vertical support middle (244).

In some embodiments, a handle first end (292) is located on a posterior horizontal support (260) close to the posterior horizontal support first end (262). In some embodiments, a handle second end (294) is located on a posterior horizontal support (260) proximal to the posterior horizontal support second end (264). In some embodiments, the handle (290) is located at an angle between 0 and 90 degrees with respect to a ground surface. In some embodiments, the angle is about 30 degrees with respect to the ground surface.

In some embodiments, the device comprises a generally wedge shaped blade (300) located on a top of the structural member (200). In some embodiments, the blade (300) comprises a generally triangular blade first side (310) and a generally triangular blade second side (320).

In some embodiments, the blade first side (310) comprises a blade first side lower edge (312), a blade first side upper edge (314), and a blade first side rear edge (316). In some embodiments, the blade second side (320) comprises a blade second side lower edge (322), a blade second side upper edge (324), and a blade second side rear edge (326).

In some embodiments, at least a part of the blade first side lower edge (312) and the blade second side lower edge (322) contacts a plane, Plane A (330), parallel to a ground surface, close to the ground surface. In some embodiments, the blade first side (310) is located at an angle between 0 and 90 degrees from Plane A (330). In some embodiments, the blade second side (320) is located at an opposite angle between 0 and 90 degrees from Plane A (330).

In some embodiments, the blade first side upper edge (314) joins the blade second side upper edge (324). In some embodiments, the blade first side rear edge (316) and the blade second side rear edge (326) remain free edges. In some embodiments, a blade first side first end (318) and a blade second side first end (328) come to a vertex. In some embodiments, a manually driven skid mounted removal device (100) is for clearing accumulated snow.

In some embodiments, the blade first side (310) and the blade second side (320) are internally concave. In some embodiments, the blade first side rear edge (316) and blade second side rear edge (326) are internally concavely curved. In some embodiments, a first side rear section (510) of the blade first side lower edge (312), flares away from a mid plane, Plane B (550). In some embodiments, a second side rear section (520) of the blade second side lower edge (322), flares away from Plane B (550). In some embodiments, Plane B (550) is perpendicular to Plane A (330). In some embodiments, the blade first side upper edge (314) and the blade second side upper edge (324) meet at Plane B (550). In some embodiments, the fist side rear section (510) of the blade first side lower edge (312) asymptotically approaches a plane, Plane C (560). In some embodiments, the second side rear section (520) of the blade second side lower edge (322) asymptotically approaches Plane C (560). In some embodiments, Plane C (560) is perpendicular to Plane A (330) and Plane B (550).

As used herein, the term "about" refers to plus or minus 10% of the referenced number. For example, an embodiment wherein the device is about 10 inches in length includes a device that is between 9 and 11 inches in length.

The disclosures of the following U.S. Patents are incorporated in their entirety by reference herein: U.S. Pat. No. D 407,723; U.S. Pat. Pub. No. 2009/0013564; U.S. Pat. No. 5,906,060; U.S. Pat. No. 2,895,237; U.S. Pat. No. 2,773,318; U.S. Pat. No. 2,460,560; U.S. Pat. No. 0,845,549.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

The reference numbers recited in the below claims are solely for ease of examination of this patent application, and are exemplary, and are not intended in any way to limit the scope of the claims to the particular features having the corresponding reference numbers in the drawings.

What is claimed is:

1. A manually driven, skid mounted snow removal device (100) for clearing accumulated snow, wherein said device (100) comprises:

(a) a structural member (200) having a first anterior vertical support (210), a second anterior vertical support (220), a first posterior vertical support (230), a second posterior vertical support (240), an anterior horizontal support (250), a posterior horizontal support (260), a first runner (270), a second runner (280), and a generally "U" shaped handle (290), wherein a first anterior vertical support first end (212) is vertically disposed on and perpendicular to the first runner (270) between a first runner first end (272) and a first runner middle (274), wherein a second anterior vertical support first end (222) is vertically disposed on and perpendicular to the second runner (280) between a second runner first end (282) and a second runner middle (284), wherein a first posterior vertical support first end (232) is vertically disposed on and perpendicular to the first runner (270) proximal to a first runner second end (276), wherein a second posterior vertical support first end (242) is vertically disposed on and perpendicular to the second runner (280) proximal to a second runner second end (286), wherein an anterior horizontal support first end (252) is horizontally disposed on and perpendicular to a first anterior vertical support middle (214), wherein an anterior horizontal support second end (254) is horizontally disposed on and perpendicular to a second anterior vertical support middle (224), wherein a posterior horizontal support first end (262) is horizontally disposed on and perpendicular to a first posterior vertical support middle (234), wherein a posterior horizontal support second end (264) is horizontally disposed on and perpendicular to a second posterior vertical support middle (244), wherein a handle first end (292) is disposed on the posterior horizontal support (260) proximal to the posterior horizontal support first end (262), wherein a handle second end (294) is disposed on the posterior horizontal support (260) proximal to the posterior horizontal support second end (264), wherein the handle (290) is disposed at an angle between 0 and 90 degrees with respect to a ground surface; and (b) a generally wedge shaped blade (300) disposed on a top of the structural member (200), wherein the blade (300) comprises a generally triangular blade first side (310) and a generally triangular blade second side (320), wherein the blade first side (310) comprises a blade first side lower edge (312), a blade first side upper edge (314), and a blade first side rear edge (316), wherein the blade second side (320) comprises a blade second side lower edge (322), a blade second side upper edge (324), and a blade second side rear edge (326), wherein the blade first side lower edge (312) and the blade second side lower edge (322) are generally disposed on a plane, Plane A (330), parallel to a ground surface, proximal to the ground surface, wherein the blade first side (310) is disposed at an angle between 0 and 90 degrees from Plane A (330), wherein the blade second side (320) is disposed at an opposite angle between 0 and 90 degrees from Plane A (330), wherein the blade first side upper edge (314) joins the blade second side upper edge (324), wherein the blade first side rear edge (316) and the blade second side rear edge (326) remain free edges, wherein a blade first side first end (318) and a blade second side first end (328) come to a vertex, wherein the manually driven skid mounted removal device (100) is for clearing accumulated snow;

wherein the blade first side (310) and the blade second side (320) are internally concave, wherein the blade first side rear edge (316) and blade second side rear edge (326) are internally concavely curved, wherein the blade first side rear edge (316) and blade second side rear edge (326) lie on Plane A (330), wherein the blade first side rear edge (316) and blade second side rear edge (326) are internally concavely curved (flared) at Plane A (330), wherein a first side rear section (510) of the blade first side lower edge (312), flares away from a mid plane, Plane B (550), wherein a second side rear section (520) of the blade second side lower edge (322), flares away from Plane B (550), wherein Plane B (550) is perpendicular to Plane A (330), wherein the blade first side upper edge (314) and the blade second side upper edge (324) meet at Plane B (550), wherein the fist side rear section (510) of the blade first side lower edge (312) asymptotically approaches a plane, Plane C (560), wherein the second side rear section (520) of the blade second side lower edge (322) asymptotically approaches Plane C (560), wherein Plane C (560) is perpendicular to Plane A (330) and Plane B (550).

2. A manually driven, skid mounted snow removal device (100) for clearing accumulated snow, wherein said device (100) consists of:

(a) a structural member (200) having a first anterior vertical support (210), a second anterior vertical support (220), a first posterior vertical support (230), a second posterior vertical support (240), an anterior horizontal support (250), a posterior horizontal support (260), a first runner (270), a second runner (280), and a generally "U" shaped handle (290), wherein a first anterior vertical support first end (212) is vertically disposed on and perpendicular to the first runner (270) between a first runner first end (272) and a first runner middle (274), wherein a second anterior vertical support first end (222) is vertically disposed on and perpendicular to the second runner (280) between a second runner first end (282) and a second runner middle (284), wherein a first posterior vertical support first end (232) is vertically disposed on and perpendicular to the first runner (270) proximal to a first runner second end (276), wherein a second posterior vertical support first end (242) is vertically disposed on and perpendicular to the second runner (280) proximal to a second runner second end (286), wherein an anterior horizontal support first end (252) is horizontally disposed on and perpendicular to a first anterior vertical support middle (214), wherein an anterior horizontal support second end (254) is horizontally disposed on and perpendicular to a second anterior vertical support middle (224), wherein a posterior horizontal support first end (262) is horizontally disposed on and perpendicular to a first posterior vertical support middle (234), wherein a posterior horizontal support second end (264) is horizontally disposed on and perpendicular to a second posterior vertical support middle (244), wherein a handle first end (292) is disposed on the posterior horizontal support (260) proximal to the posterior horizontal support first end (262), wherein a handle second end (294) is disposed on the posterior horizontal support (260) proximal to the posterior horizontal support second end (264), wherein the handle (290) is disposed at an angle between 0 and 90 degrees with respect to a ground surface; and (b) a generally wedge shaped blade (300) disposed on a top of the structural member (200), wherein the blade (300) consists of a generally triangular blade first side (310) and a generally triangular blade second side (320), wherein the blade first side (310) consists of a blade first side lower edge (312), a blade first side upper edge (314), and a blade first side rear edge (316), wherein the blade second side (320) consists of a blade second side lower edge (322), a blade second side upper edge (324), and a blade second side rear edge (326), wherein the blade first side lower edge (312) and the blade second side lower edge (322) are generally disposed on a plane, Plane A (330), parallel to a ground surface, proximal to the ground surface, wherein the blade first side (310) is disposed at an angle between 0 and 90 degrees from Plane A (330), wherein the blade second side (320) is disposed at an opposite angle between 0 and 90 degrees from Plane A (330), wherein the blade first side upper edge (314) joins the blade second side upper edge (324), wherein the blade first side rear edge (316) and the blade second side rear edge (326) remain free edges, wherein a blade first side first end (318) and a blade second side first end (328) come to a vertex, wherein the manually driven skid mounted removal device (100) is for clearing accumulated snow;

wherein the blade first side (310) and the blade second side (320) are internally concave, wherein the blade first side rear edge (316) and blade second side rear edge (326) are internally concavely curved, wherein the blade first side rear edge (316) and blade second side rear edge (326) lie on Plane A (330), wherein the blade first side rear edge (316) and blade second side rear edge (326) are internally concavely curved at Plane A (330), wherein a first side rear section (510) of the blade first side lower edge (312), flares away from a mid plane, Plane B (550), wherein a second side rear section (520) of the blade second side lower edge (322), flares away from Plane B (550), wherein Plane B (550) is perpendicular to Plane A (330), wherein the blade first side upper edge (314) and the blade second side upper edge (324) meet at Plane B (550), wherein the fist side rear section (510) of the blade first side lower edge (312) asymptotically approaches a plane, Plane C (560), wherein the second side rear section (520) of the blade second side lower edge (322) asymptotically approaches Plane C (560), wherein Plane C (560) is perpendicular to Plane A (330) and Plane B (550).

* * * * *